United States Patent [19]

Penny

[11] 4,054,398

[45] Oct. 18, 1977

[54] CENTRIFUGAL COMPRESSOR OR CENTRIPETAL TURBINE

[75] Inventor: Robert Noel Penny, Solihull, England

[73] Assignee: Caterpillar Tractor Co., Peoria, Ill.

[21] Appl. No.: 599,687

[22] Filed: July 28, 1975

[30] Foreign Application Priority Data

Aug. 8, 1974 United Kingdom ..... 34917/74

[51] Int. Cl.[2] ..... F04D 29/44

[52] U.S. Cl. ..... 415/211; 415/12; 415/156; 415/160; 415/161; 415/DIG. 1

[58] Field of Search ..... 415/151, 12, 160, 161, 415/DIG. 1, 206, 211, 156

[56] References Cited

U.S. PATENT DOCUMENTS

| | | | |
|---|---|---|---|
| 1,637,652 | 8/1927 | Ness | 415/206 |
| 2,337,861 | 12/1943 | Adamtchik | 415/161 |
| 2,404,334 | 7/1946 | Whittle | 415/211 |
| 2,614,747 | 10/1952 | Christensen | 415/156 |
| 2,648,195 | 8/1953 | Wilde et al. | 415/161 |
| 3,038,698 | 6/1962 | Troyer | 415/12 |
| 3,042,371 | 7/1962 | Fanti | 415/12 |
| 3,150,823 | 9/1964 | Adams | 415/211 |
| 3,405,865 | 10/1968 | Lagelbauer | 415/DIG. 1 |
| 3,489,339 | 1/1970 | Greenwald | 415/211 |
| 3,768,919 | 10/1973 | O'Connor | 415/151 |

FOREIGN PATENT DOCUMENTS

| | | | |
|---|---|---|---|
| 963,540 | 1/1950 | France | 415/DIG. 1 |
| 212,935 | 8/1909 | Germany | 415/DIG. 1 |
| 659,211 | 4/1938 | Germany | 415/DIG. 1 |
| 1,033,966 | 7/1958 | Germany | 415/12 |
| 1,938,132 | 1/1971 | Germany | 415/DIG. 1 |
| 151,440 | 3/1962 | Switzerland | 415/161 |
| 1,043,168 | 9/1966 | United Kingdom | 415/DIG. 1 |
| 1,085,227 | 9/1967 | United Kingdom | 415/DIG. 1 |

*Primary Examiner*—C. J. Husar

*Attorney, Agent, or Firm*—Gifford, Chandler, Sheridan & Sprinkle

[57] ABSTRACT

A diffuser for a centrifugal compressor or a nozzle assembly for a centripetal turbine comprising a pair of axially-spaced walls defining an annular housing open at its inner and outer peripheries and a plurality of vanes extending between the walls and defining therewith, between adjacent vanes, working fluid passages open to the inner and outer peripheries of the housing, each vane being defined by a pair of partitions having a common edge extending between the housing walls adjacent the inner periphery of the housing and spaced apart circumferentially at positions remote from the inner periphery of the housing.

7 Claims, 12 Drawing Figures

CENTRIFUGAL COMPRESSOR OR CENTRIPETAL TURBINE

BACKGROUND OF THE INVENTION

The invention relates to a centrifugal compressor and is particularly concerned with a diffuser therefor. The invention is also applicable to a centripetal turbine and to a nozzle assembly therefor. The diffuser and nozzle assembly are herein referred to generically as "a working fluid guidance assembly" and the centrifugal compressor and centripetal turbine are herein referred to generically as "a radial flow turbo-machine".

One object of the invention is to provide a lightweight working fluid guidance assembly, as hereinbefore defined, which is also cheap and quick to manufacture. Another object of the invention is to provide a working fluid guidance assembly, as hereinbefore defined, which is of adjustable or variable geometry.

SUMMARY OF THE PRESENT INVENTION

According to the invention, a working fluid guidance assembly, as hereinbefore defined, comprises a pair of axially spaced walls defining an annular housing open at its inner and outer peripheries and a plurality of vanes extending between the walls and defining therewith, between adjacent vanes, working fluid passages open to the inner and outer peripheries of the housing, each vane comprising a pair of partitions having a common edge extending between the housing walls adjacent the inner periphery of the housing and being spaced apart circumferentially at positions remote from the inner periphery of the housing.

At least one of the partitions of each pair may be adjustable toward or away from the adjacent partition of an adjacent pair of partitions. In this way the throat width or shape of each working fluid passage or the angle of attack may be made adjustable or variable.

Means may be provided to move the or each movable partition of a pair of partitions in response to a variable operational parameter. The parameter may be any operational parameter of a compressor or turbine or of an engine in which the working fluid guidance assembly is fitted.

One or both partitions of a vane-defining pair may be discontinuous in its length or have pores or apertures therein, whereby working fluid can be extracted from a working fluid passage bounded by one or other of the partitions and introduced into the space between the partitions of the vane-defining pair. This, for example, enables the boundary layer of working fluid to be sucked into the spaces between the partitions by reducing the pressure in those spaces. The spaces between the partitions defining the vanes may be interconnected to a common surge chamber or may themselves form individual surge chambers.

Preferably the paritions are made of sheet metal or other material and may be supported at their edges by the housing walls. Conveniently the partitions are supported at their edges by support plates located in recesses in the respective walls. The edge support may be by interengaging tongues and notches, for example spigots and sockets, provided respectively on the partitions and in the housing walls or support plates or vice versa. Where a partition is adjustable in position the notches would be made elongate in the directions in which the co-operating tongues are to be movable.

DESCRIPTION OF THE DRAWINGS

By way of example diffusers for a centrifugal compressor are now described with reference to the accompanying drawings, in which.

DESCRIPTION OF A PREFERRED EMBODIMENT

Figure 1:
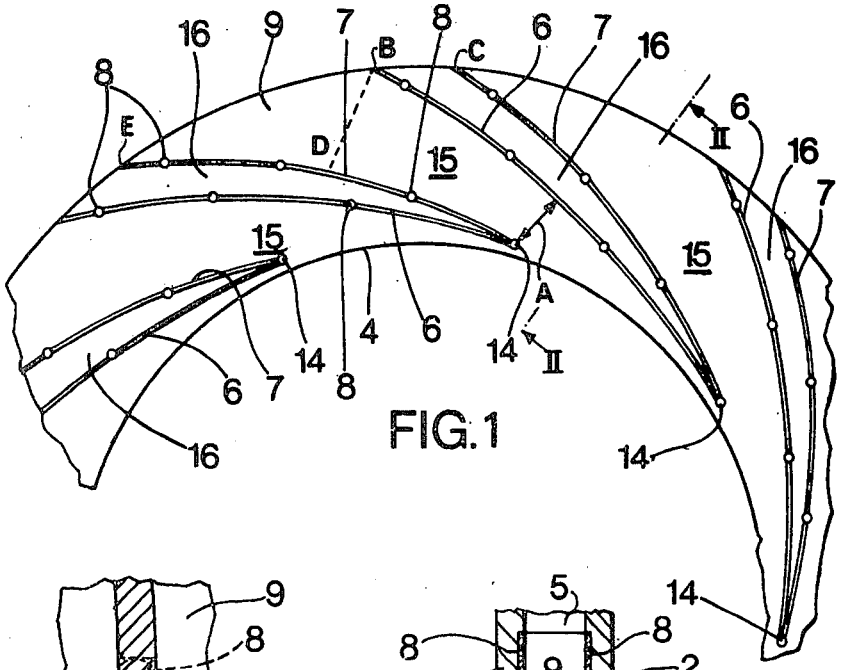
FIG. 1 is a diagrammatic end view of a first diffuser.
Figure 3:
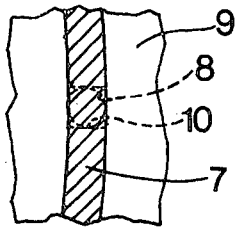
FIGS. 3 and 3*a* are respectively scrap views to a larger scale than FIGS. 1 and 2 showing a first method of vane location looking respectively at an edge and a face of a partition from which the vane is constructed.
Figure 3A:
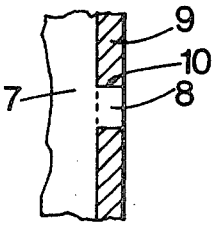
Figure 2:
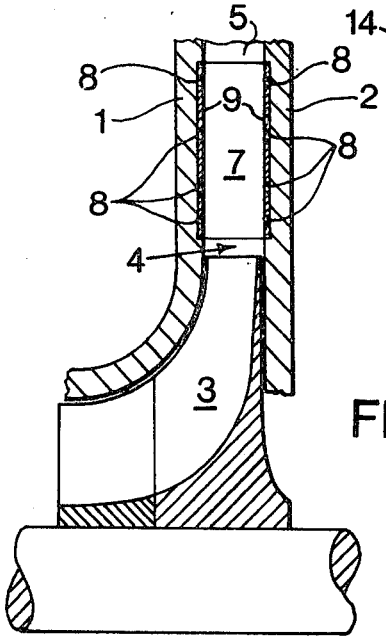
FIG. 2 is an axial section on the line II—II in FIG. 1 through a centrifugal compressor fitted with the diffuser shown in FIG. 1 but showing one diffuser vane in elevation instead of in section on the line II—II.

Referring first to FIGS. 1 and 2, the diffuser shown therein comprises a housing formed from two axially spaced walls 1, 2 which may be extensions (as shown) of the housing walls containing an impeller 3 of the centrifugal compressor. The housing has a peripheral inlet 4 communicating with the outlet periphery of the impeller and a peripheral outlet 5 leading to a delivery duct (not shown). The diffuser contains a plurality of circumferentially-spaced vanes each being formed from a pair of partitions 6, 7 of sheet metal or other suitable sheet material extending between and supported by the walls 1, 2. The partitions 6 and 7 have several (e.g., four) spigots 8 extending from each of their side edges and located in holes 10 in support plates 9, located in recesses in the inside faces of the walls 1, 2. This method of support is shown to a larger scale in FIGS. 3 and 3*a*.

Figure 4:
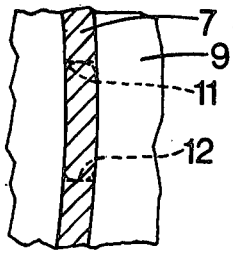
FIGS. 4 and 4*a* are views similar to FIGS. 3 and 3*a* respectively and showing a second method of vane location.
Figure 4A:
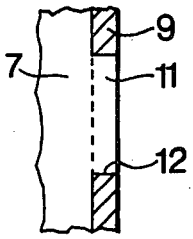

FIGS. 4 and 4*a* illustrate a second method of locating the partitions 6 and 7 by using spaced tongues 11 extending from the side edges of the partitions and inserted into slots 12 in the support plates 9 or directly into notches in the walls 1, 2.

Figure 5:
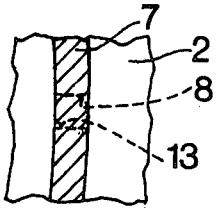
FIGS. 5 and 5*a* are views similar to FIGS. 3 and 3*a* respectively and showing a third method of vane location.
Figure 5A:
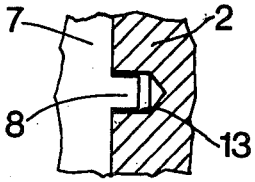

FIGS. 5 and 5*a* illustrate a third method of locating the partitions 6 and 7 by using spigots 8 extending from the side edges of the partitions and located directly into sockets 13 in the walls 1, 2 themselves.

Other ways of fixing the partitions to the walls 1, 2 may be employed. For example, the edges of the partitions may be slid into grooves formed in the end faces of the walls.

Referring again to FIG. 1, it will be seen that the leading edges of each pair of partitions 6 and 7 are coincident at 14 and that the partitions diverge towards the outer periphery 5. The relative positions of the partitions 6 of one vane and the partition 7 of an adjacent vane determine the shape of the working fluid passage 15 between vanes, the throat width A (as shown in FIG. 1) and the angle of attack. There is a space 16 within each vane between the partitions 6 and 7 which define the vane. This may be closed or partially closed at the outer periphery at BC in FIG. 1 or be left open. By making one or both partitions 6 or 7 porous or by providing apertures therein and by reducing the pressure within the spaces 16, working fluid can be sucked into the spaces 16. This is a useful facility where a boundary layer of fluid is to be removed.

The spaces 16 may be used as individual surge chambers or they may be interconnected to a common surge chamber externally of the diffuser.

If desired, the partitions 6 and 7 need not extend fully to the outer periphery 5 of the diffuser. For example, the portion of each partition 7 extending beyond a point D opposite to the outer tip B of the partition 6 of one adjacent vane may be omitted between the point D and the outer tip E of that partition.

By fabricating the diffuser vanes from the partitions of sheet metal or other sheet material in the manner described with reference to FIGS. 1 and 2 with FIGS. 3 and 3*a* or FIGS. 4 and 4*a* or FIGS. 5 and 5*a*, a lightweight diffuser can be cheaply and quickly manufactured. Other advantages are that by suitable location of the partition-supporting spigots or equivalent means any desired shape of diffuser passage 15 and any desired throat width A or angle of attack can be produced. By altering the positions of the holes or sockets for the spigots, or equivalent means, the shape of the diffuser passages 15 can readily be changed. Furthermore finished and accurate passage walls are provided by the partitions 6 and 7 without any machining of vane profiles. The metal or other sheet material employed for the partitions can therefore be harder than those that would normally be employed for diffuser vanes and thus the likelihood of erosion is reduced.

Figure 6:
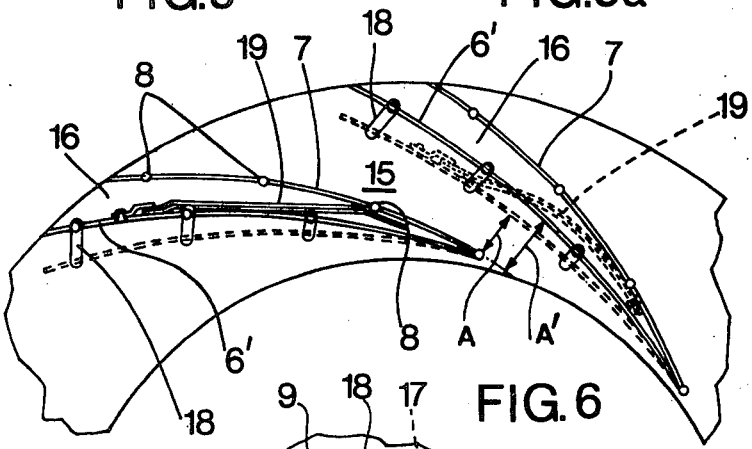
FIG. 6 is a similar view to FIG. 1 showing another diffuser.
Figure 7:
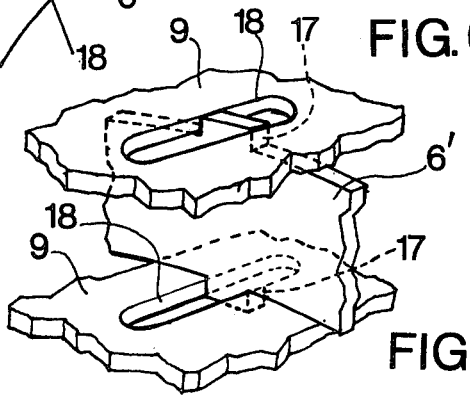
FIG. 7 is a perspective view showing the method of vane location employed in the diffuser shown in FIG. 6.

Referring now to FIGS. 6 and 7, one of the partitions 7 of a pair defining a vane is fixed in position, for example by means of spigots 8, between the walls 1 and 2 (as in FIGS. 3 and 3*a*), and the other partition 6' is movable toward and away from the fixed partition 7. In this way the width of the working fluid passage 15 is made variable and so the throat width and angle of attack may be varied in order to make an engine, of which the compressor with the diffuser is a part, more flexible in operation, for example, in respect of speed, efficiency and anti-surge characteristics. The movable partitions 6' are provided with tongues 17 extending from their side edges and slidable in slots 18 in supporting plates such as plates 9 in FIGS. 1 and 2, the slots being elongate in the required direction of movement of the partitions 6' (see FIG. 7). The movable partitions 6' may be moved by any convenient actuating means responsive to a variable operational parameter of the compressor or an engine of which the compressor is a part. For example, a temperature responsive element may be used. This may be a bi-metallic strip 19 connected between the partitions 6' and 7 of a vane and responsive to the temperature of the partition, the temperature of a fluid introduced into the space 16 between the partitions 6' and 7 or to any other temperature arising within or outside the engine. The lengths of the slots 18 determine the extent of movement of the partitions 6' and hence the minimum and maximum throat widths indicated in FIG. 6 by A and A', the throat width varying with rising or falling temperature.

In some applications it may be more convenient to move the partitions 7 instead of the partition 6'. In yet another arrangement each of a pair of partitions 6' and 7 may be made adjustable and have its own or common actuating means.

Figure 8:
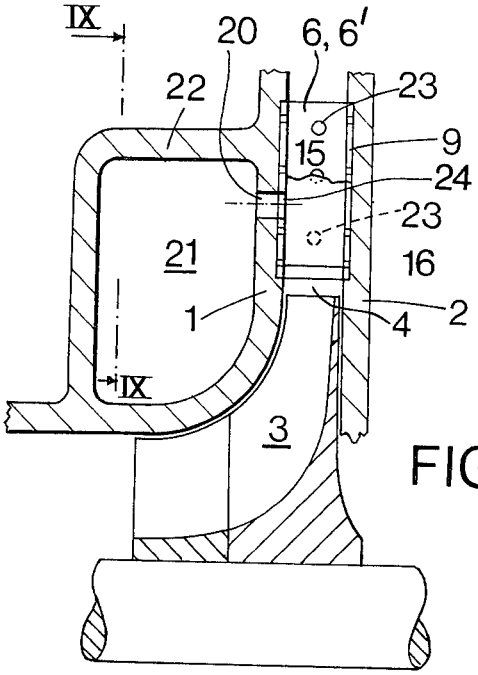
FIG. 8 is an axial section similar to FIG. 2 showing yet another diffuser.
Figure 9:
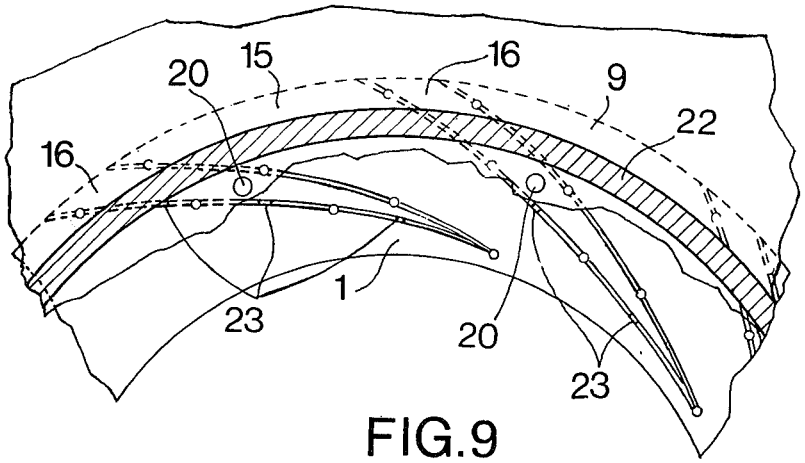
FIG. 9 is a similar view to FIG. 1 of the diffuser shown in FIG. 8.

As in the first diffuser, shown in FIGS. 1 and 2, the spaces 16 between the partitions 6' and 7 may communicate through pores or apertures in the partitions 6' and 7 with the working fluid passages 15 or be used as anti-surge chambers or be interconnected externally of the diffuser for the latter purpose. FIGS. 8 and 9 show an annular anti-surge chamber 21 formed integrally with the housing wall 1 and bounded by the wall 1 and an annular wall 22. The wall 1 has a ring of holes 20 communicating with interior of chamber 21 and each communicating with a hole 24 in adjacent support plate 9 with one of the spaces 16 within each vane which is defined by the partitions 6 and 7 of FIG. 1 or the partitions 6' and 7 of FIG. 6. Working fluid passing between adjacent vanes is admitted to the adjacent spaces 16 through ports 23 formed in one or both partitions defining each vane. The ports 23 are shown for example in the partition 6 of FIG. 1 or the partition 6' of FIG. 6.

Although the illustrated constructions are for diffusers for use with centrifugal compressors, similar constructions may be used as nozzle assemblies for use with centripetal turbines.

What I claim as my invention and desire to secure by Letters Patent of the United States is:

1. A working fluid guidance assembly for a radial flow turbo-machine, the assembly comprising a pair of axially spaced walls defining an annular housing open at its inner and outer peripheries, each said wall having in the face thereof defining the interior of said housing a recess, a pair of plates located one in each said recess and a plurality of vanes extending between said plates and defining therewith, between adjacent vanes, working fluid passages open to the inner and outer peripheries of said housing, each vane comprising a pair of partitions having a common edge extending between said plates adjacent the inner periphery of the housing and spaced apart circumferentially at positions remote from the inner periphery of said housing, each said partition being of sheet form and supported at each axial edge thereof, said assembly also comprising adjacent each axial edge of each partition at least one interengaging pair of tongue and notch elements effecting the support of said partition, one element of each interengaging pair of elements provided on said partition adjacent the axial edge thereof to be supported by said interengaging pair of elements and the other element of said interengaging pair of elements supported by said plate adjacent said axial edge.

2. An assembly as claimed in claim 1 in which at least one partition of each pair of partitions is adjustably spaced from the adjacent partition of an adjacent pair of partitions and said notch elements associated with said adjustable partitions are elongate in the direction of the adjustment of said adjustable partitions, said assembly also comprising means operable to move said adjustable partitions in response to a variable operating condition.

3. An assembly as claimed in claim 1 including a common surge chamber interconnecting the spaces between the pair of partitions defining each said vane.

4. A radial flow turbo-machine including a working fluid guidance assembly as claimed in claim 1.

5. A working fluid guidance assembly for a radial flow turbo-machine, the assembly comprising a pair of axially spaced walls defining an annular housing open at its inner and outer peripheries and a plurality of vanes extending between said walls and defining therewith, between adjacent vanes, working fluid passages open to the inner and outer peripheries of said housing, each vane comprising a pair of partitions having a common edge extending between said walls adjacent the inner periphery of the housing and spaced apart circumferentially at positions remote from the inner periphery of said housing, each said partition being of sheet form and supported at each axial edge thereof, said assembly also comprising adjacent each axial edge of each partition at least one interengaging pair of tongue and notch elements effecting the support of said partition, one element of each interengaging pair of elements provided on said partition adjacent the axial edge thereof to be supported by said interengaging pair of elements and the other element of said interengaging pair of elements supported by said wall adjacent said axial edge, at least one partition of each pair of partitions being adjustably spaced from the adjacent partition of an adjacent pair of partitions and said notch elements associated with said adjustable partitions being elongate in the direction of the adjustment of said adjustable partition, said assembly also comprising means operable to move said adjustable partitions in response to a variable operating condition.

6. An assembly as claimed in claim 5 including a common surge chamber interconnecting the spaces between the pair of partitions defining each said vane.

7. A radial flow turbo-machine including a working fluid guidance assembly as claimed in claim 5.

* * * * *

UNITED STATES PATENT AND TRADEMARK OFFICE

CERTIFICATE OF CORRECTION

PATENT NO. : 4,054,398

DATED : October 18, 1977

INVENTOR(S) : Robert Noel Penny

It is certified that error appears in the above-identified patent and that said Letters Patent are hereby corrected as shown below:

Col. 2, line 22, after "diffuser", delete --and--.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*